US011241737B2

(12) United States Patent
Feistritzer et al.

(10) Patent No.: US 11,241,737 B2
(45) Date of Patent: Feb. 8, 2022

(54) MANUFACTURING A HARD-METAL PRESSED ARTICLE

(71) Applicant: Horn Hartstoffe GmbH, Tübingen (DE)

(72) Inventors: Stefan Feistritzer, Tübingen (DE); Dieter Hermes, Rottenburg (DE)

(73) Assignee: Hom Hartstoffe GmbH, Tübingen (DE)

( * ) Notice: Subject to any disclaimer, the term of this patent is extended or adjusted under 35 U.S.C. 154(b) by 0 days.

(21) Appl. No.: 16/134,217

(22) Filed: Sep. 18, 2018

(65) Prior Publication Data

US 2019/0015900 A1 Jan. 17, 2019

Related U.S. Application Data

(63) Continuation of application No. PCT/EP2017/056297, filed on Mar. 16, 2017.

(30) Foreign Application Priority Data

Mar. 18, 2016 (DE) ..... 10 2016 105 076.8

(51) Int. Cl.
*B22F 3/03* (2006.01)
*B22F 3/16* (2006.01)
(Continued)

(52) U.S. Cl.
CPC ..... *B22F 3/03* (2013.01); *B22F 3/02* (2013.01); *B22F 3/16* (2013.01); *B30B 11/007* (2013.01);
(Continued)

(58) Field of Classification Search
CPC ..... B22F 3/03; B22F 2003/033
See application file for complete search history.

(56) References Cited

U.S. PATENT DOCUMENTS

2006/0165828 A1* 7/2006 Smilovici ..... B22F 3/03 425/78
2013/0039798 A1* 2/2013 Satran ..... B22F 3/03 419/38
(Continued)

FOREIGN PATENT DOCUMENTS

CN 203343437 U 12/2013
CN 203711840 U 7/2014
(Continued)

OTHER PUBLICATIONS

International Search Report for International Application No. PCT/EP2017/056297, dated Jul. 7, 2017.
(Continued)

*Primary Examiner* — Jophy S. Koshy
*Assistant Examiner* — Joshua S Carpenter
(74) *Attorney, Agent, or Firm* — Jason H. Vick; Sheridan Ross, PC

(57) ABSTRACT

Manufacturing a hard-metal pressed article includes providing a multi-part die, feeding at least one frontal mold part, feeding at least one transverse mold and locking the at least one frontal mold part and the at least one transverse mold part to define a cavity for the article. Feed directions of the at least one frontal mold part and the at least one transverse mold part are inclined. The at least one frontal mold part and the at least one transverse mold part define surfaces of the article. The resulting cavity includes at least one opening through which a punch is insertable. Next, a filling shoe is fed above an opening of the cavity and fills the cavity with a powder, and the powder is compressed with at least one punch. The feeding of the transverse mold part takes place along a feed direction that is parallel to the main pressing direction.

13 Claims, 7 Drawing Sheets

(51) Int. Cl.

| | |
|---|---|
| ***B22F 5/00*** | (2006.01) |
| ***B30B 15/02*** | (2006.01) |
| ***B30B 11/00*** | (2006.01) |
| ***B22F 3/02*** | (2006.01) |
| ***C22C 29/00*** | (2006.01) |
| ***B30B 15/30*** | (2006.01) |

(52) U.S. Cl.
CPC ..... *B30B 15/022* (2013.01); *B30B 15/304* (2013.01); *C22C 29/00* (2013.01); *B22F 2003/033* (2013.01); *B22F 2005/001* (2013.01); *B30B 15/026* (2013.01)

(56) References Cited

U.S. PATENT DOCUMENTS

| | | | | |
|---|---|---|---|---|
| 2013/0266681 | A1* | 10/2013 | Cripps ..... | B22F 3/03 425/234 |
| 2015/0037444 | A1 | 2/2015 | Vukovic | |
| 2017/0043397 | A1 | 2/2017 | Sterkenburg | |
| 2017/0246687 | A1 | 8/2017 | Schwarz et al. | |

FOREIGN PATENT DOCUMENTS

| | | | | |
|---|---|---|---|---|
| CN | 204770656 U | | 11/2015 | |
| EP | 2933041 | A1 * | 10/2015 | ..... B30B 15/304 |
| EP | 2933041 | A1 | 10/2015 | |
| EP | 2933043 | A1 | 10/2015 | |
| JP | 2010-142863 | A | 7/2010 | |
| SU | 1154043 | A1 | 5/1985 | |
| SU | 1614899 | A1 | 12/1990 | |
| SU | 1804946 | A1 | 3/1993 | |
| WO | WO 2015/120496 | | 8/2015 | |

OTHER PUBLICATIONS

Written Opinion for International Application No. PCT/EP2017/056297, dated Jul. 7, 2017.

International Preliminary Report on Patentability for International Application No. PCT/EP2017/056297, dated Sep. 27, 2018.

Intent to Grant for corresponding European Application No. 17711167.1, dated Dec. 4, 2019.

Office Action for corresponding Russian Application No. 2018132867/02(053833), dated Aug. 21, 2019.

Decision to Grant for corresponding Russian Application No. 2018132867/02(053833), dated Dec. 16, 2019.

First Office Action for corresponding Chinese Patent Application No. 201780018263.7, dated Jan. 6, 2021.

* cited by examiner

MANUFACTURING A HARD-METAL PRESSED ARTICLE

CROSS-REFERENCES TO RELATED APPLICATIONS

This application is a continuation of international patent application PCT/EP2017/056297, filed on Mar. 16, 2017 designating the U.S., which international patent application has been published in German language and claims priority to German patent application 10 2016 105 076.8, filed on Mar. 18, 2016. The entire contents of these priority applications are incorporated herein by reference.

BACKGROUND

The present disclosure relates to a method and a device for the manufacture of a hard-metal pressed article and a hard-metal pressed article. The present disclosure further relates to the manufacture of blanks for the sintering of components made of hard-metals, for instance cutting tools. Cutting tools may include cutting inserts, indexable tipped tools, and the like.

Cutting tools made from hard-metal (carbide, cemented carbide) are generally sintered at high temperatures. Two essential methods are known for the production of precisely shaped intermediates, also known as pressed articles (pellets), blanks or green bodies. One method relates to the primary forming production by injection molding. Another approach relates to the manufacture of pressed articles by means of pressing. The present disclosure primarily relates to the pressing of hard-metal powder at high pressures for manufacturing pressed articles for the powder metallurgical production of cutting tools or such like.

US 2017/0246687 A1 describes a forming tool for the powder metallurgical production of a green article, with an upper punch and a lower punch, which are movable along a common pressing axis, a die body with a filling well for receiving powder material, wherein the die body comprises an upper region, in which the upper punch is movably guided in the filling well along the pressing axis, and a lower region in which the lower punch is movably guided in the filling well along the pressing axis, and comprising at least two transverse sliders which form a forming region which defines the lateral outer contour of a green article, and which are arranged on the die body displaceable in a direction that deviates from the pressing axis, wherein the at least two transverse sliders only come into contact with one another when the at least two transverse sliders are arranged in their respective end position, wherein a cavity, which defines the shape of a pressed green article, is formed in a closed state of the forming tool by the lower punches and upper punches that are arranged in their end positions and by the at least two transverse sliders that are arranged in their end positions, and wherein the at least two transverse sliders form a forming region which defines the entire lateral outer contour of a green article.

A method and a device for producing a green article are known from US 2017/0043397 A1, wherein the device comprises a first punch, a second punch, a first die part and a second die part, wherein the first punch, the second punch and the first die part cooperate to form the green article, wherein the second die part comprises an opening for receiving the second punch, but does not form a surface of the green article.

A method and a device for producing a green article for a cutting insert are known from US 2017/0043397 A1, wherein the device comprises an upper die part, a lower die part, an upper punch and a lower punch that cooperate with one another to form the green article, wherein the die parts and the punches are each vertically movable.

Tool geometries are known that require pressed articles that cannot be produced in accordance with the above described pressing method without complex reworking. The post-processing increases the production effort. Conversely, not all the desired geometries and designs of hard-metal pressed articles can be produced by means of conventional pressing methods for the production of green parts, either without post-processing or with low post-processing. Conversely, this leads to a design of such tools that takes into account the manufacturing conditions, so that compromises have to be made. This can limit the performance of the tools.

An example of a hard-metal tool is a so-called indexable insert, for instance a so-called two-edge cutter, which comprises two cutting edges. Two-edge cutters are known which are designed with point symmetry. In other words, such a two-edge cutter may comprise for instance a base body having a longitudinal extension, wherein a cutting edge is respectively formed at a first end thereof and at a second end facing away from the first end, wherein the cutting edges are oriented in opposite directions relative to a center of the base body. Such a design requires specific measures during the manufacture of the pressed articles (pellets). In exemplary applications, various design principles must be observed. For instance, the cavity in which the pressed article is formed is generally arranged in a certain way in relation to a main pressing axis. Presses for the manufacture of hard-metal pressed articles usually include an upper punch and a lower punch, which are movable towards each other along the main pressing axis in order to pressurize and compress a powder that is accommodated in a cavity.

Furthermore, when designing dies for the powder metallurgical manufacture of hard-metal pressed articles, care should be taken not to provide a mold separation that runs over or across the cutting edges. Nevertheless, the cutting edges lie in a main parting line, in certain cases. This can lead to the fact that blanks for certain cutting tools cannot be produced by pressing without post-processing or with only little post-processing.

Another challenge in the design of pressing tools for the manufacture of pressed articles for hard-metal tools is the demolding of beveled, pointed chamfers and/or tangential transitions that lead into the parting line. This often results in parts of the die and/or parts of the press, which reflect the shape of the pressed article, having to be very thin-walled or pointed, at least partially. This increases wear and the risk of breakage and is therefore avoided, at least in some cases.

Hard-metal pressed articles are pressed at very high pressures, which can reach ranges from about 2000 to about 4000 bar (0.2 to 0.4 GPa). The pressing of hard-metal powders cannot easily be compared or even equated with the pressing of mere metal powders or other powder materials. One reason for this is the so-called rebound action of pressed hard-metal pressed articles. In contrast to pressed articles based on metal powder, hard-metal pressed articles are made to a not inconsiderable extent of plasticizers (e.g. paraffin, waxes) and are porous, i.e. have air inclusions or cavities. The rebound action may result in an increase in volume after pressing, which can amount to about 3% of the initial volume, for instance.

Pressing devices for hard-metal pressing generally comprise no other punches apart from the main punches that are assigned to the main pressing axis. As already described above, the main punches are usually an upper punch and a lower punch, which are movable vertically, and which are for instance movable towards each other to produce the pressed article.

In the field of hard-metal powder metallurgy, these main punches cannot simply be supplemented by additional (lateral) punches, which are for instance designed similar to lateral sliders in injection molding but are operated as punches. This is in part caused by the high pressures during the pressing process. Such (lateral) punches would also have a negative impact on the pressing density distribution of the pressed article. Press density distribution is also referred to in this disclosure as press structure distribution.

The above limitation does not preclude that occasionally secondary punches or auxiliary punches are used that are moved along a plane that is inclined relative to the vertical direction. However, such auxiliary punches are usually only used to create subordinate contours, such as apertures, lateral troughs or the like. The effective surface with which such an auxiliary punch acts on the pressed article is usually considerably smaller than the surface of the respective side of the die wall surrounding the pressed article.

In order to create requested component structure and design, for instance a sufficiently homogeneous pressing density, it is usually the goal to design the main punches in such a way that, viewed in a vertical direction, they cover the silhouette and/or the contour of the pressed article as completely as possible. If this were not the case, a main die would be significantly smaller than the silhouette of the pressed article. This would result in unfavorable stress distributions or pressure distributions during pressing, since not the whole cross-section of the pressed article would be directly exposed to the pressing pressure (primarily) generated by the main punch.

Apart from the punches, a die for pressing blanks for the manufacture of hard-metal cutting tools usually comprises other mold parts which are not actively involved in the pressing process (as a driven punch). Such mold parts may generally be movable and are then referred to as sliders, for instance. However, fixed mold parts are also conceivable. In general, the mold parts themselves are not moved during the actual pressing process. Movable mold parts, such as slides or the like, are moved for the demolding process in order to demold the pressed article.

In view of this, it is an object of the present disclosure to present a method for the near-net-shape manufacture of hard-metal pressed articles, for instance for the manufacture of sinter raw parts for cutting tools, which allows a high degree of design freedom with regard to the tool geometry and a manufacture with a favorable press structure and/or with a favorable press density distribution.

It is a further object of the present disclosure to present a respective method that enables and simplifies the manufacture of hard-metal pressed articles with a point-symmetrical design.

It is a further object of the present disclosure to present a method that is suitable for the manufacture of pressed articles for cutting tools that have cutting edges that are oriented in opposite directions and that face away from each other.

It is further object of the present disclosure to present a method for the manufacture of hard-metal pressed articles for cutting tools that enables the manufacture of cutting edges that are not affected, in particular crossed, by form partitions or burrs shall be presented.

It is a further object of the present disclosure to present a method for the manufacture of hard-metal pressed articles that enables the utilization of punches that are designed to be particularly robust.

Similarly, it is a further object of the present disclosure to present a method for the manufacture of hard-metal pressed articles that enables the utilization of mold parts that are not provided with excessively thin and pointed shape portions.

It is a further object of the present disclosure to present a corresponding manufacturing device, particularly a pressing apparatus, and a pressed article obtainable through the manufacturing method and/or through a manufacture using the presented manufacturing device.

SUMMARY

In regard of the method, these and other objects are achieved by a method for the near-net-shape manufacture of hard-metal pressed articles, for instance for the manufacture of sinter raw parts for cutting tools, the method comprising the following steps:

providing a multi-part die comprising:

feeding at least one frontal mold part which is movable in a first plane, for instance a horizontal plane, feeding at least one transverse mold part which is movable in a second plane, for instance in a vertical plane, locking the at least one frontal mold part and the at least one transverse mold part to define a cavity for a pressed article, wherein feed directions of the at least one frontal mold part and the at least one transverse mold part are oriented inclined to one another, for instance perpendicular to one another, wherein the at least one frontal mold part and the at least one transverse mold part define surfaces of the pressed article, and wherein the resulting cavity comprises at least one opening through which a punch is insertable, feeding a filling shoe above an opening in the cavity and filling the cavity with a hard-metal powder, and compressing the powder with at least one punch that is movable parallel to a main pressing direction, wherein the at least one transverse mold part is fed along a feed direction that is parallel to the main pressing direction.

In accordance with the invention, the feed axis of the at least one transverse mold part is oriented parallel to the main pressing axis, i.e. to the feed axis of the at least one punch. Nevertheless, the at least one transverse mold part is mainly used to shape a lateral section of the pressed article. The at least one punch is used to shape at least one upper or lower section of the pressed article. The feed direction of the transverse mold part allows, in certain embodiments, the demolding of geometries that cannot be produced with parts that are demolded exclusively laterally (along the horizontal plane). In this way, the total number of parts required to form the die can be limited. Nevertheless, a high degree of design freedom is enabled.

By way of example, the first plane and the second plane are the horizontal plane and the vertical plane. However, this is not to be understood to be limiting. In general, the first plane and the second plane can be understood as planes that are oriented at an angle to each other, for instance as planes that are oriented perpendicular to each other.

Pressed articles may be produced that are provided with outer surfaces that are slightly inclined to the main direction of compression and/or have tangential radii, for instance. In addition, undercut contours can be demolded which otherwise cannot be easily demolded without further processing. For example, with certain types of indexable inserts having two cutting edges that are oriented in opposite directions, a burr line across the cutting edge of the cutting tool can be avoided.

The feeding of the at least one frontal mold part and the at least one transverse mold part may involve a retraction or a transfer of the mold parts into a closed position, for instance. Locking can include, for instance, locking, fixing and generally holding the mold parts firmly in the closed position. In this way it is made clear that the at least one frontal mold part and the at least one transverse mold part are not punches.

It goes without saying that the term near-net-shape manufacture does not exclude the possibility that the pressed articles will shrink during a subsequent sintering process, as the particles are further compressed and/or as binding agents and the like are removed.

By way of example, in certain embodiments, the method is suitable for the manufacture of hard-metal pressed articles for cutting inserts with little or no post-processing. In the context of the present disclosure, low post-processing and/or no post-processing shall be understood in such a way that no costly grinding processes or other material-removing processes are required in which considerable amounts of the material are removed. Nevertheless, the designation "low post-processing and/or no post-processing" does not exclude the possibility that a cutting edge that has already been formed may be processed. Furthermore, this does not exclude the removal of separation burrs and the like.

In an exemplary embodiment of the method, the at least one frontal mold part is fed laterally, wherein the at least one frontal mold part comprises a frontal shaping portion defining a lateral portion of the shape of the pressed article, and wherein the at least one transverse mold part is fed vertically and provided with a lateral shaping portion defining a further lateral portion of the shape of the pressed article.

Accordingly, at least one frontal part can be referred to as a lateral slider. In accordance with the above design, the at least one transverse mold part is also fed vertically, i.e. from above or below. Nevertheless, a lateral shaping portion is provided, which does not primarily define an upper or a lower section of the shape of the pressed article. In other words, a frontal section of the at least one transverse mold part is not only provided with a shaping portion for the pressed article.

In the context of the present disclosure, a frontal shaping portion of a mold part is a portion or surface extending substantially perpendicular to the direction of feed. On the other hand, a lateral shaping portion is oriented approximately parallel to the feed direction. Deviations are conceivable, especially for the formation of non-straight contours of the pressed article. In the case of the at least one transverse mold part, the feed direction and (main) orientation of the shaping portion are thus separated. In other words, when locking the at least one transverse mold part, it has to be observed that a simple locking in the feed direction is not sufficient. Rather, other measures must be taken to withstand the pressing pressure, which also acts on the transverse mold part transversely or at least at an angle in relation to the feed direction.

According to a further exemplary embodiment, the at least one punch is fed vertically, wherein the at least one punch comprises a frontal shaping portion which defines a section of the shape of the pressed article, wherein the shaping portion of the punch is for instance designed to be insensitive to breakage and, in certain embodiments, provided with blunt depressions for forming corresponding elevations of the pressed article. In accordance with this embodiment, thin-walled or even pointed sections can be dispensed with in the shaping portion of the punch. Nevertheless, pressed articles with tapers, bevels, radii or tangential transitions can be produced.

According to a further exemplary embodiment, the step of providing a multi-part die comprises feeding an upper transverse mold part and a lower transverse mold part, wherein the step of compressing comprises feeding an upper punch and a lower punch, wherein the upper punch and the upper transverse mold part are associated with a first side, for instance an upper side, wherein the lower punch and the lower transverse mold part are associated with a second side, for instance a lower side, wherein the upper punch and the upper transverse mold part are fed at least partially via common guide elements, and wherein the lower punch and the lower transverse mold part are fed at least partially via common guide elements.

As a result, in certain embodiments, when the punches and the transverse mold parts use the same guide elements and/or support each other. This is possible because the respective feed directions are oriented parallel to each other.

In preparation for a pressing process, the cavity is usually formed by moving the mold parts involved (still without the punches) from an open position to a closed position. In the closed position, the mold parts are fixed and/or locked in place. Accordingly, the transverse mold parts can provide a guide for the punches. In this way possible space problems in the upper area and in the lower area of the die can be avoided. This applies, in certain embodiments, with regard to the fact that the upper punch and the lower punch may cover the entire upper and lower silhouette of the pressed article. This allows a favorable formation of the pressed structure, in certain embodiments.

According to a further exemplary embodiment, the upper punch and the lower transverse mold part together define a first cutting edge, wherein the lower punch and the upper transverse mold part together define a second cutting edge.

In this way, both the first cutting edge and the second cutting edge, which are associated with a first and a second edge, may be arranged in the (main) parting line. Burr lines or mold partitions across the cutting edge can be avoided. Accordingly, the upper punch cooperates with the lower transverse mold part. The lower punch cooperates with the upper transverse mold part. Accordingly, the shaping portions of the transverse mold parts not only form lateral contours of the cavity, but at least partially also form an upper area or a lower area. The upper punch contacts the lower transverse mold part during pressing. The lower punch contacts the upper transverse mold part during pressing. This means that in the region where the respective transverse mold parts are formed, the upper punch and the lower punch do not act directly against each other or overlap.

According to a further exemplary embodiment, the first cutting edge is associated with a first rake face and a first relief face, wherein the second cutting edge is associated with a second rake face and a second relief face, and wherein the first rake face is formed by the upper punch, the second rake face by the lower punch, the first relief face by the lower transverse mold part, and the second relief face by the upper transverse mold part.

In this way, an indexable insert of the two-edge cutter type can be manufactured, for instance an indexable insert with a point-symmetrical design.

According to a further exemplary embodiment, a demolding step follows after the step of compressing the powder, involving opening the multi-part die, comprising extending the at least one frontal mold part, extending the at least one transverse mold part, and extending the at least one punch, wherein the at least one transverse mold part is moved parallel to the main pressing direction in order to release lateral contours of the pressed article which cannot be removed laterally in the present configuration of the die.

This design is applicable, for example, for shine turning tools or similarly designed cutting tools with circular cutting edges and/or cutting edges shaped as a circle segment, which have in either case a diameter greater than a width of a base body of the insert. Such a cutting insert has a bone-like design, for instance. A central portion of the "bone" may therefore be formed by corresponding frontal mold parts, wherein the ends of the "bone" are demolded by the upper punch and the lower transverse mold part and by the lower punch and the upper transverse mold part, respectively. In this way, cutting edges may also be demolded that are facing away from one another and that are oriented in opposite directions to one another.

According to a further exemplary embodiment, the step of feeding a filling shoe comprises laterally feeding the filling shoe to an upper opening of the cavity, wherein the filling shoe is guided into a clearance space provided by the upper punch that is spaced away from the cavity.

The cavity is usually filled with the powder with the aid of gravity. For this purpose, the filling shoe is fed laterally and, for example, disposed over the opening of the cavity into which the upper punch is inserted during the pressing process. Accordingly, the upper punch is extended during filling. In certain embodiments, the upper transverse mold part is designed in such a way that sufficient space is available for the filling shoe to fill the cavity. Accordingly, the guide provided directly or mediately for the upper punch by the upper transverse mold part permits a corresponding disengagement movement of the upper punch.

In another aspect, the present disclosure also relates to a method for the manufacture of hard-metal cutting tools, for instance cutting inserts:

manufacturing a pressed article according to a design of the method described herein, processing the article with little or no post-processing, for instance transfer from a pressing plant to a sintering plant, and sintering of the pressed articles.

In certain embodiments, parts processing refers to parts handling, which includes, for example, transferring the pressed articles from the pressing device to a sintering device. Temporary storage may be necessary in between. However, defined processing steps may also be carried out on the pressed article, e.g. automated deburring. Deburring can be done by brushing or blowing, and usually aims at unpressed components at the pressed article.

In regard of the device, the above and other objects of the present disclosure are achieved by a device for the near-net-shape manufacture of hard-metal pressed articles, for instance for the manufacture of raw parts to be sintered for cutting tools, comprising a bed, a multi-part die for forming a cavity, which comprises at least one frontal mold part which is movable in a first plane, for instance in a horizontal plane, and at least one transverse mold part, which is movable in a second plane, for instance in a vertical plane, wherein the at least one frontal mold part and the at least one transverse mold part are associated with guides that are oriented inclined or at an angle to one another, for instance perpendicular to one another, wherein the at least one frontal mold part and the at least one transverse mold part are movable between an open position and a closed position, wherein the at least one frontal mold part and the at least one transverse mold part define surfaces of the pressed article in the closed position, and wherein the resulting cavity comprises at least one opening through which a punch of a punch unit can be inserted, wherein the device further comprises a filling unit and a punch unit, wherein the filling unit comprises a filling shoe, which can be fed to an opening in the cavity to fill the cavity with a hard-metal powder, wherein the punch unit comprises at least one punch that is movable along a main pressing direction for compressing the powder, and wherein the at least one transverse mold part can be fed along a feed axis that is parallel to the main pressing direction.

The at least one frontal mold part and the at least one transverse mold part are slide-like parts of the die. These are not punches. In the following, by way of example, the horizontal plane is also referred to as the X-Y plane, with reference to a coordinate system to be defined hereinafter. Accordingly, a Z-direction is also provided, which defines a vertical direction that is parallel to the main pressing direction. Any plane that is parallel to or coincident with the vertical direction is referred to in the present disclosure as vertical plane.

In certain embodiments, the at least one frontal mold part and the at least one transverse mold part define substantially lateral surfaces and/or lateral portions of the pressed article.

According to a further exemplary embodiment, the device comprises at least two frontal mold parts whose shaping portions are facing each other and which are movable between an open position and a closed position, at least two transverse mold parts whose shaping portions face each other and which are movable between an open position and a closed position, and at least two punches whose shaping portions face each other and which are movable between an open position and a closed position.

According to a further embodiment, the device comprises exactly two punches, namely an upper punch and a lower punch, and exactly two transverse mold parts, namely an upper transverse mold part and a lower transverse mold part. By way of example, there may also be provided exactly two frontal mold parts. These can be referred to, for example, as forward frontal mold part and rear frontal mold parts.

Embodiments are conceivable in which all die parts representing the pressed article are designed as movable mold parts. Nevertheless, alternative designs are also conceivable in which at least a portion of the cavity is designed as a fixed mold part.

According to a further exemplary embodiment, the at least one frontal mold part is laterally feedable and provided with a frontal shaping portion defining a portion of the shape of the pressed article, wherein the at least one transverse mold part is provided with a lateral shaping portion that defines a further portion of the shape of the pressed article.

According to another exemplary embodiment, the at least one punch comprises a frontal shaping portion which defines a further portion of the shape of the pressed article. In certain embodiments, the shaping portion of the punch is designed to be insensitive to breakage. By way of example, the shaping portion comprises blunt depressions (or elevations) to form corresponding elevations (or depressions) of the pressed article.

According to another exemplary embodiment, at least one punch of the punch unit and at least one transverse mold part of the die are guided parallel to each other. According to another exemplary embodiment, at least one punch of the punch unit and at least one transverse mold part of the die use the same guide elements, at least partially.

In accordance with a further exemplary embodiment, the upper transverse mold part provides a guide portion for the upper punch. By way of example, similarly, the lower transverse mold part provides a guide portion for the lower punch. The upper punch and the upper transverse mold part as well as the lower punch and the lower transverse mold part, respectively, may also be coupled together mediately via a common guide.

According to another exemplary embodiment, the punch unit comprises a upper punch and a bottom punch, wherein the die comprises an upper transverse mold part and a lower transverse mold part, wherein the upper punch and the upper transverse mold part use at least partially the same guide elements, and wherein the bottom punch and the lower transverse mold part use at least partially the same guide elements.

According to another exemplary embodiment, the upper punch and the lower transverse mold part together define a first cutting edge of the pressed article, and the lower punch and the upper transverse mold part together define a second cutting edge of the pressed article.

According to another exemplary embodiment, the first cutting edge is associated with a first rake face and a first relief face of the pressed article, wherein the second cutting edge is associated with a second rake face and a second relief face of the pressed article, wherein the first rake face is formed by the upper punch, the second rake face by the lower punch, the first relief face by the lower transverse mold part, and the second relief face by the upper transverse mold part.

According to a further embodiment, the device further comprises a locking device which fixes the transverse and frontal mold parts in the closed position in order to form a circumferential contour of the pressed article. The locking device is for instance designed in the shape of a ring. In other words, the locking device may laterally enclose the transverse mold parts and the frontal mold parts in order to secure them in the closed position.

The cavity is locked by the locking device to withstand the high pressing pressures. The locking device can cause a non-positive and/or positive locking. The locking device can fix the transverse mold parts and the frontal mold parts relative to each other and/or relative to the bed of the device. The closed locking device may also be described as a circumferential holding device. By way of example, the locking device is a mechanically operating holding device.

By way of example, the upper transverse mold part also contributes to the provision of sufficient space that is available for the filling shoe. In certain embodiments, the upper transverse mold part may provide a guide or be coupled to a guide that is also used by the upper punch. Furthermore, the upper transverse mold part is also designed in such a way that the filling shoe can reach the opening of the cavity. This can be achieved, for example, by making appropriate cutouts in the transverse mold part.

According to another aspect, the present disclosure relates to a hard-metal pressed article, for instance a pressed article for an indexable tool, which is produced with little or no post-processing, comprising at least one cutting edge, which is defined by a parting plane of a multi-part die, the pressed part comprising a pressing structure profile and/or a pressing density profile defined by a main pressing axis, which requires a certain orientation in the die, comprising a design which cannot be demolded exclusively laterally, for instance caused by the arrangement of the at least one cutting edge, wherein at least one lateral section of the pressed article, for instance a relief face portion which is inclined or curved relative to the main pressing axis, is formed by a lateral shaping portion of a transverse mold part whose direction of movement in the die is oriented parallel to the main pressing axis, wherein at least a lateral portion of the molding is formed by a frontal shaping portion of a frontal mold part whose direction of movement in the die is oriented perpendicular to the main pressing axis. Such a pressed article can be manufactured according to a design of the method described herein. In certain embodiments, the pressed article is manufactured in an embodiment of the device described herein.

In certain embodiments, the pressed article is a hard-metal cutting insert that comprises two cutting edges which are symmetrical to each other, for instance point symmetric. In certain embodiments, the pressed article does not have any burrs caused by the die of the pressing device that cross the cutting edges of the edges.

If a cutting tool is produced on the basis of the pressed article that is produced with little or no post-processing, it can be seen in the cutting tool whether it is manufactured in accordance with an embodiment of the method described herein and/or in accordance with an embodiment of the device described herein. In certain embodiments, burrs, the route of the parting line and other design features, including areas that cannot easily be demolded by means of (lateral) sliders, allow a respective conclusion.

By way of example, at the pressed article there may be formed with little or no post-processing: Cutting edges, tangential transitions, chip grooves, relief faces or relief angles, taperings, curved or circular cutting edges which have a shape which makes lateral demolding difficult, or the like.

The present disclosure is not limited to such cutting inserts and, in certain embodiments, in particular not exclusively to the two-edge cutter described above with two cutting edges arranged opposite and oriented in opposite directions. Nevertheless, reference is made to these types of cutting inserts for illustrative purposes.

It is to be understood that the manufacturing method has similar and/or identical exemplary embodiments as the manufacturing design, and vice versa, in particular as defined in the dependent claims and as disclosed in the embodiments discussed herein.

It is to be understood that the previously mentioned features and the features mentioned in the following may not only be used in a certain combination, but also in other combinations or as isolated features without leaving the spirit and scope of the present disclosure.

BRIEF DESCRIPTION OF THE DRAWINGS

Further features and advantages of the disclosure are disclosed by the following description of a plurality of exemplary embodiments, with reference to the drawings, wherein.

DETAILED DESCRIPTION OF EXEMPLARY EMBODIMENTS

With reference to FIGS. 1, 2, 3 and 4, an exemplary embodiment of a pressed article 10 (also referred to as pellet or green article) is illustrated, which can be used for the powder metallurgical manufacture of a hard-metal tool, for instance a cutting insert. The pressed article 10 can be produced without post-processing or with little post-processing by means of powder pressing. However, this requires a specific design of a device and/or a specific method for the manufacture of the pressed article.

The pressed article 10 serves primarily as an illustrative example for a large number and variety of other pressed articles, the manufacture of which can be performed in accordance with aspects described herein, relating to the device and/or the method.

At least in principle, the shape of the pressed article 10 can also be obtained using alternative methods and devices, such as injection molding or alternative pressing methods for the manufacture of raw parts (also referred to as intermediates or blanks). Nevertheless, each of these alternative approaches may have certain disadvantages, depending on the actual circumstances, which are at least partially overcome within the context of the present disclosure. When a pressed article that is at least similarly shaped is produced using conventional pressing methods, post-processing is indispensable. Generally, a rough contour is obtained by pressing or injection molding, which must be extensively machined, especially by grinding.

The method and the device according to the present disclosure enable, according to at least some embodiments, a significant reduction and/or even elimination of such post-processing by means of grinding. In other words, it can be manufactured close to the final contour (net shape) and with only little post-processing and/or no post-processing.

Figure 3:
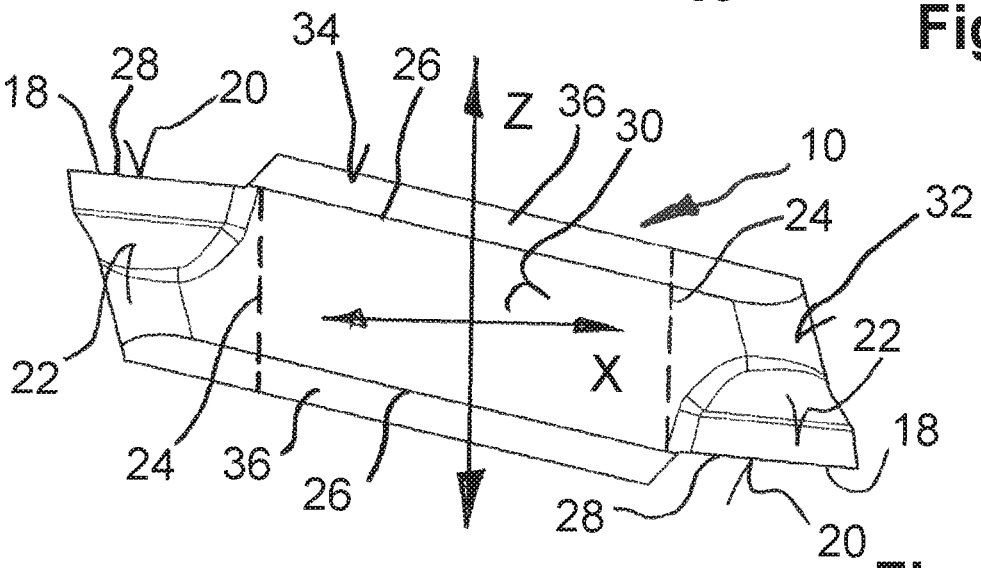
FIG. 3 is a frontal view of the arrangement of FIG. 1.
Figure 4:
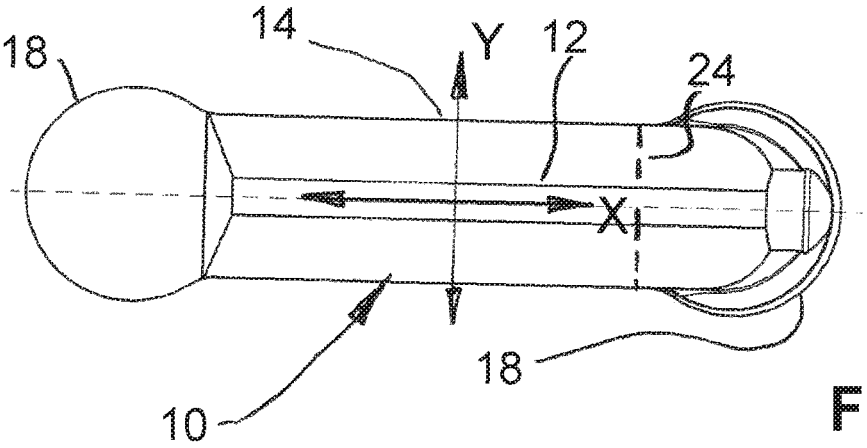
FIG. 4 is a top view of the arrangement of FIG. 1.

In combination, a Cartesian coordinate system X, Y, Z can be derived from FIGS. 3 and 4, which is used for illustrative purposes herein. An X-axis designates a longitudinal axis. A Y-axis designates a transverse axis. A Z-axis designates a height axis. It goes without saying that other assignments and designations may be used. The person skilled in the art can easily understand the necessary conceptual transformations and assignments. The same applies to position and direction information, such as above, below, laterally, transversely, in front, behind and the like. The X, Y, Z coordinate system is referred to repeatedly for illustrative purposes hereinafter.

The pressed article 10 comprises a main body 12, which substantially extends in a longitudinal direction X, cf. also FIG. 3 and FIG. 4. A cutting edge 18 is formed at the respective end of the main body 12, which defines a cutter edge 16. The cutting edge 18, by way of example, is arranged as a cutting edge 18 which has a circular shape, at least partially. Tools with such cutting edges may be used for gloss processing and/or gloss turning, for example.

It can be seen for instance from the illustration according to FIG. 4, which shows a plan view, that the cutting edges 18 have a diameter and/or a transverse extension (in the Y direction) which is greater than a transverse extension of the main body 12. Accordingly, a tapering or constriction 14 is formed between the ends that are provided with the cutting edges 18.

As it is generally known, the cutter edges 16 include a rake face 20 and a relief face 22, which includes a tapering. The cutter edges 16 are designed with point symmetry with respect to a center of the pressed article 10. This allows a simple change between the two cutter edges 16 by a 180° rotation of the cutting insert.

In certain embodiments, the pressed article 10 is oriented in a cavity of a pressing device in such a way that the Z axis coincides with a main pressing direction. Accordingly, special measures must be taken to ensure that the pressed article 10 can be demolded with the smallest possible number of mold parts and punches within the context of manufacturing approaches that come as close to the final contour as possible, and that requires little post-processing or no post-processing at all.

According to the view orientation in FIG. 4, the main pressing axis Z is oriented perpendicular to the view there. In other words, a punch would "see" the silhouette shown in FIG. 4. If one would try to demold the relief faces 22 of the cutter edges 16 with the punches movable in the main pressing direction Z, this would lead to very thin walls at the punches.

In the case of an exclusively lateral demolding, in which for instance two sliders are provided, which are movable along the Y direction, each slider would basically form the contour or silhouette shown in FIG. 3. However, in the region of the outer ends (in the X direction) of the cutting edges 18, this would lead to a mold partition and thus to the formation of burr. This is undesirable.

Therefore, in the context of the present disclosure, it is proposed to demold the pressed article 10 by an interaction of frontal mold parts and transverse mold parts.

Figure 1:
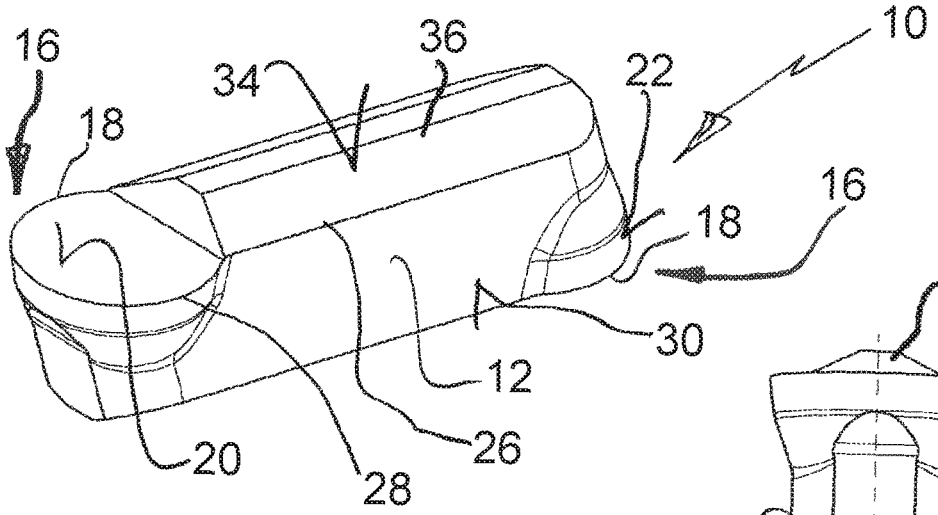
FIG. 1 is a perspective view of a hard-metal cutting tool which can be produced according to at least some aspects of the present disclosure.
Figure 2:
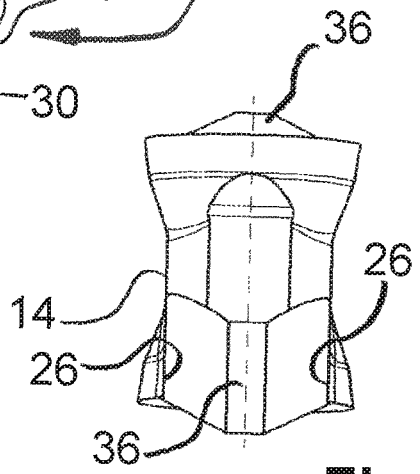
FIG. 2 is a side view of the arrangement of FIG. 1.

In FIG. 3 dotted lines indicated by 24 designate an area which can be demolded laterally in the transverse direction Y by respective sliders. A slider that is arranged to be cuboid or trapezoid can extend between the lines 24. In FIGS. 1 and 3, further mold partitions 26, 28 are indicated. The mold partition 28 is basically congruent with the cutting edges 18. The mold partition 26 represents a transition between a side surface of the main body 12 and an elevation 36 at the respective upper and lower back 34 of the main body 12.

In FIG. 3, the mold partitions 24 and 26 define an area 30, which can be demolded by a so-called frontal mold part. The area 30 is basically flat. A surface designated by 32 indicates the area that can be demolded by means of a so-called transverse mold part. The area 32 is basically congruent with the relief face 22. Accordingly, the area 32 contains a tapering in the Z-direction.

An area designated by 34 is defined by the mold partitions 26, 28 and describes the portion which can be demolded by a punch which is movable in the main pressing direction Z. By way of example, the surface 34 involves the rake surface 20 including the ridge-shaped elevation 36.

The ridge-shaped elevation 36 is arranged to be obtuse or obtuse-angled in the Z direction. Accordingly, the elevation 36 can be shaped by the geometry of the punches without significant, disadvantageous reductions in the wall thickness of the punches.

In certain embodiments, on the basis of the mold partitions 24, 26, 28 and the progression of the press density that is caused by the main pressing axis Z, at least in the raw state of the pressed article 10, it is possible to draw conclusions about the type of manufacturing and the design of a die used for manufacturing. In addition, in certain embodiments, the type of manufacturing and the design of a die used for manufacturing may also be derived even in the sintered state of the workpiece from the mold partitions 24, 26, 28.

With reference to FIGS. 5 to 11, exemplary aspects and designs of a device as well as a method for the near-net-shape manufacture of pressed hard-metal parts are elucidated. The device is overall designated by 40. The device 40 may be arranged as a part of a pressing plant, for example. In certain embodiments, the device 40 is arranged to produce hard-metal pressed articles based on hard-metal powder whose shape is at least similar to the shape of the pressed articles 10 illustrated in FIGS. 1 to 4, by way of example.

For illustrative purposes, the following figures show simplified representations of the pressed article 10 and components of the device 40. The orientation of the pressed article 10 in the device 40 is elucidated by the coordinate system X, Y, Z, which is shown in at least some of the figures described hereinafter.

In certain embodiments, the device 40 is used for processing hard-metal powder for the manufacture of hard-metal pressed articles for the powder metallurgical manufacture of cutting inserts, inserts etc.

Figure 6:
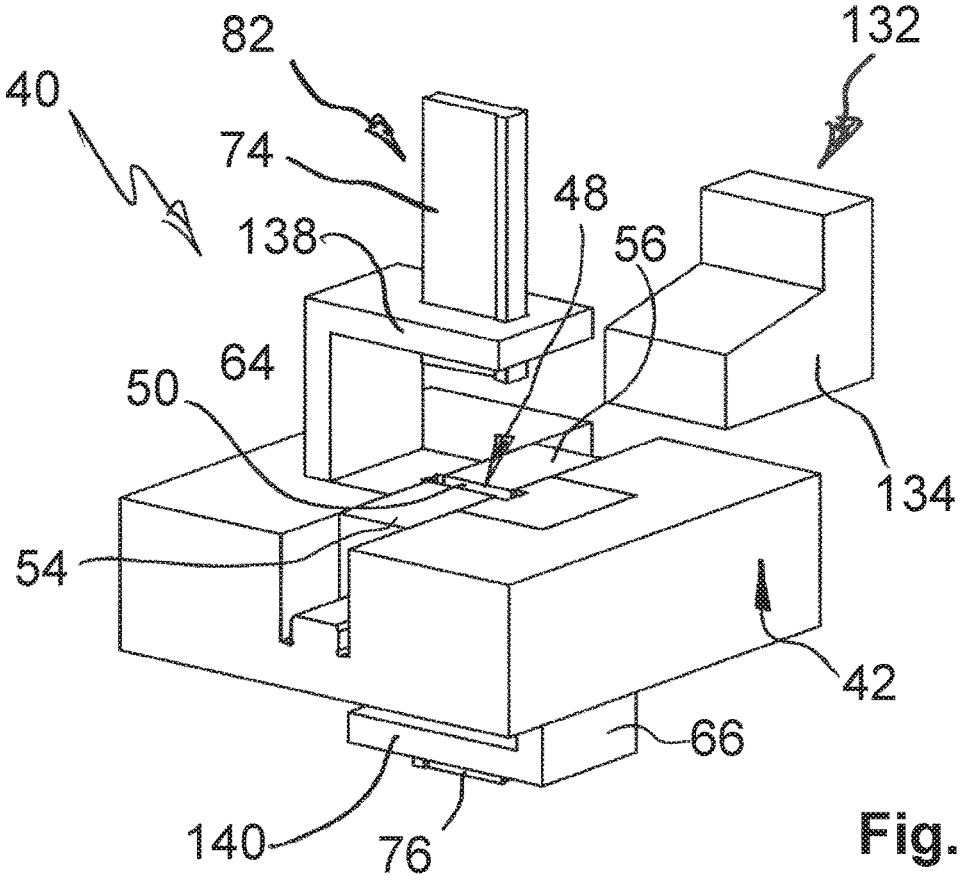
FIG. 6 is another view of the arrangement according to FIG. 5 in a filling configuration.
Figure 7:
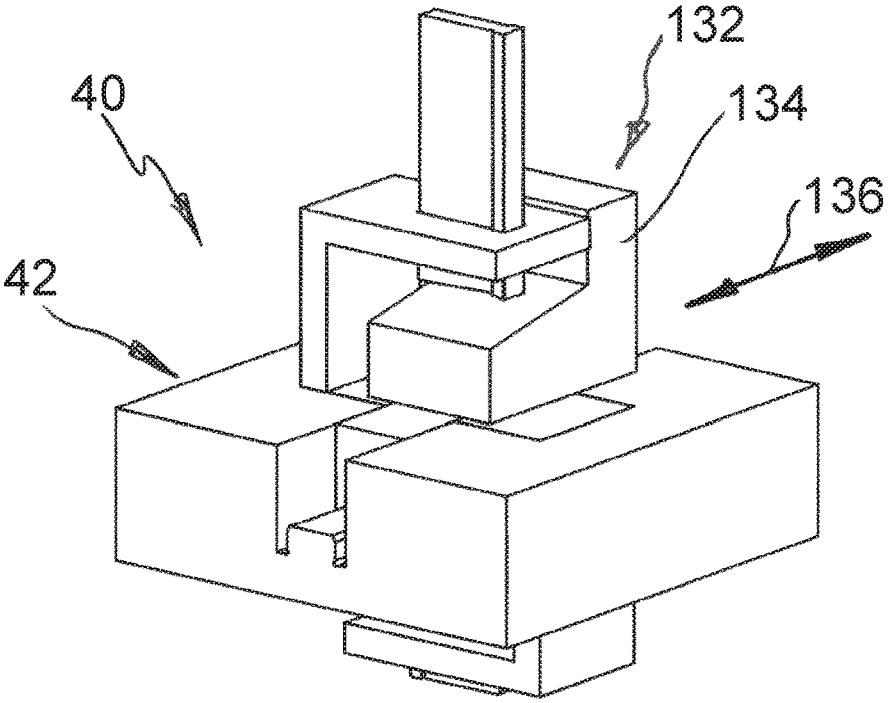
FIG. 7 is a further view of the arrangement according to FIG. 6, wherein a filling shoe is placed over an opening of a cavity.

The device comprises a bed 42 which can be part of or at least coupled to a frame. Furthermore, a die 46 is provided, which forms a cavity 48, cf. also FIG. 6. An (upper) opening 50 of the cavity 48 is also shown in FIG. 6.

The die 46 comprises a first frontal mold part 54 and a second frontal mold part 56, which are mounted on the bed 42 offset from one another in the transverse direction Y, for instance. Accordingly, the first frontal mold part 54 is mounted on a horizontal guide 58. The second frontal mold part 56 is mounted on a horizontal guide 60. The horizontal guides 58, 60 are arranged as profile guides, for instance.

Figure 5:
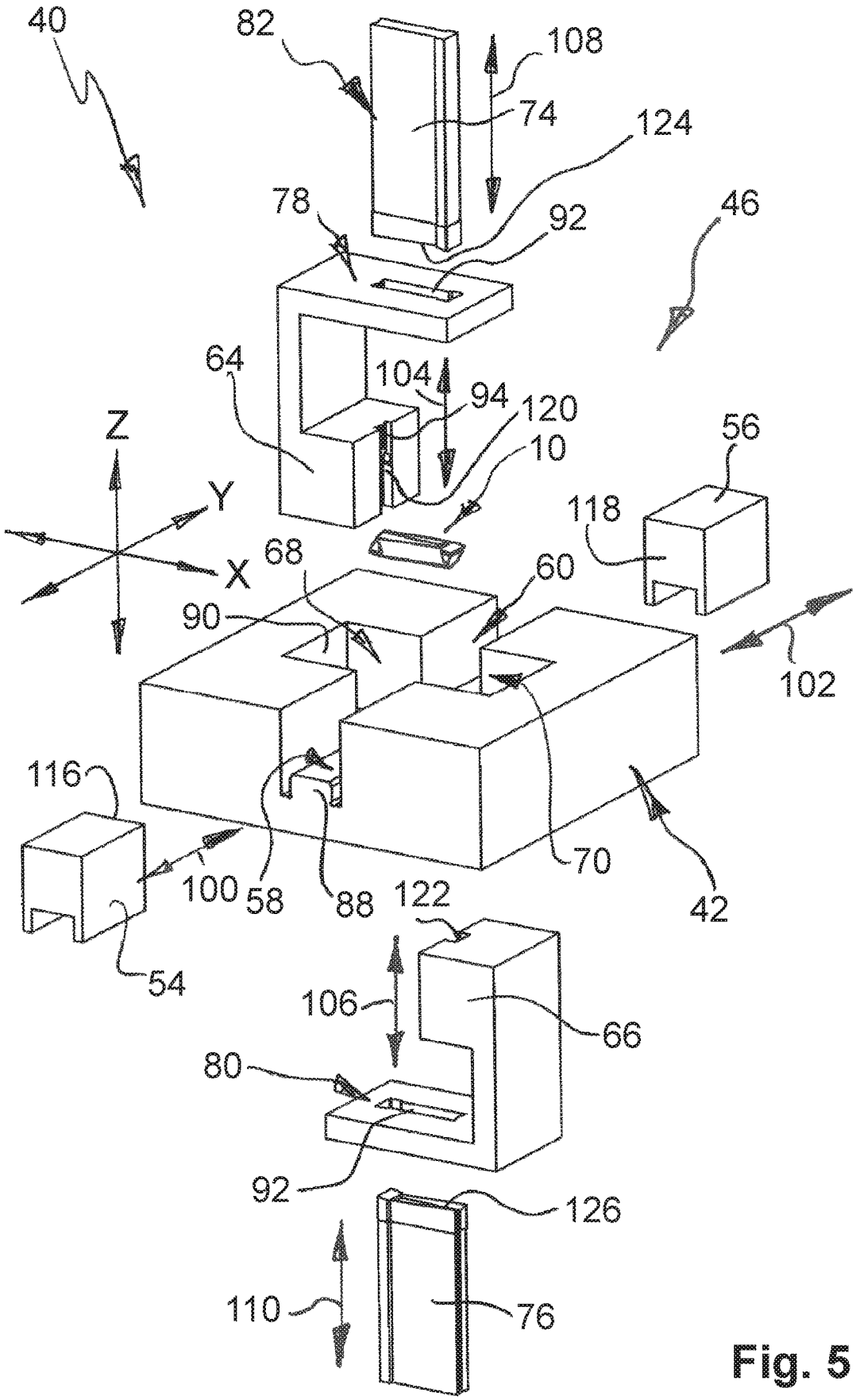
FIG. 5 is a schematic perspective view of a pressing device for hard-metal pressed articles, in an exploded state.

Further, the die 46 comprises so-called transverse mold parts 64, 66. The exemplary embodiment illustrated in FIGS. 5 to 11 comprises a first transverse mold part 64 and a second transverse mold part 66. In FIG. 5, the first transverse mold part 64 is assigned to a first side of the device 40, which may also be referred to as the top side. The second transverse mold part 66 is assigned to a second side of device 40, which may also be referred to as the lower side. The transverse mold parts 64, 66 are offset from each other in the vertical direction along the vertical axis Z.

A vertical guide 68 is provided for the movement of the first transverse mold part 64. A vertical guide 70 is provided for moving the second transverse mold part 66. Via the vertical guides 68, 70, the transverse mold parts 64, 66 are coupled to the bed 42.

The frontal mold parts 54, 56 and the transverse mold parts 64, 66 together define parts of the die 46 which are not actively moved during the actual pressing process. The mold parts 54, 56, 64, 66 are opened to demold the pressed article 10. Punches 74, 76 can be retracted for the molding the pressed article 10 through openings 50 in the (closed) cavity 48, which is defined by the mold parts 54, 56, 64, 66. In the exemplary embodiment of the device 40 illustrated in FIGS. 5 to 11, the cavity 48 is formed exclusively by moving parts. However, this does not exclude the possibility that in other exemplary embodiments shaping portions of the cavity 48 are formed by mold parts that are fixedly coupled to the bed 42.

The device 40 comprises punches 74, 76 that are assigned to a punch group or punch unit 82. The first punch 74 may also be referred to as the upper punch. The second punch 76 may also be referred to as the lower punch. Accordingly, the first punch 74 is assigned to an upper side of the device 40 or the die 46. The second punch 76 is assigned to a bottom side of the device 40 or the die 46. In the pressing of hard-metal pressed articles to provide blanks to be sintered, generally two punches 74, 76 are used, which are arranged opposite to each other in the height direction or vertical direction Z and offset from each other, and which may approach one another in order to compress and to bring the hard-metal powder that is accommodated in the cavity 48 into shape.

A first vertical guide 78 is provided for the movement of the first punch 74. A second vertical guide 80 is provided to move the second punch 76. According to at least some exemplary embodiments, the vertical guide 80 of the punch 74 is directly or mediately coupled with the first transverse mold part 64. The vertical guide 80 of the second punch 76 is, for example, directly or mediately coupled with the second transverse mold part 66.

The horizontal guides 58, 60 for the frontal mold parts 54, 56 comprise a guide profile 88, which may also be referred to as the guide base. A corresponding counter profile is formed on the frontal mold parts 54, 56.

The vertical guides 68, 70 for the transverse mold parts 64, 66 also include a guide profile 90, which is arranged on the bed 42. The transverse mold parts 64, 66 can contact the guide profile 90 via a corresponding counter profile.

The vertical guides 78, 80 for the punches 74, 76 of the punch unit 82 comprise guide profiles 92 and 94. At least in accordance with the exemplary embodiment illustrated in FIGS. 5 to 11, the guide profiles 92, 94 of the vertical guides 78, 80 are not arranged directly on or fixedly coupled to the machine bed 42. Instead, the guide profiles 92, 94 are directly or mediately assigned to or coupled with the transverse mold parts 64, 66. In other words, the transverse mold parts 64, 66 can provide the guide for the punches 74, 76 for the movement in the Z-direction, or at least be part of such a guide. In certain embodiments, this is enabled by the fact that the transverse mold parts 64, 66 and the punches 74, 76 are movable parallel to one another in the Z-direction.

In FIG. 5, feed directions or directions of movement of the mold parts 54, 56, 64, 66 and the punches 74, 76 are indicated by double arrows. The feed direction of the frontal mold part 54 is indicated by 100. The feed direction of the frontal mold part 56 is indicated by 102. The feed direction of the transverse mold part 64 is indicated by 104. The feed direction of the transverse mold part 66 is indicated by 106. The feed direction of the punch 74 is indicated by 108. The feed direction of the punch 76 is indicated by 110.

The frontal parts 54, 56 can be fed along a horizontal plane defined by the axes X, Y. The transverse mold parts 64, 66 can be fed along a vertical plane which is oriented parallel to the Z axis and/or which coincides with the Z axis. In other words, the frontal mold parts 54, 56 can be fed laterally. The horizontal fittings 64, 66 can be fed vertically (from above and/or from the bottom). The punches 74, 76 may also be fed vertically (from above and/or from the bottom). The first transverse mold part 64 and the first punch 74 have parallel feed directions 104, 108. The second transverse mold part 66 and the second punch 76 have parallel feed directions 106, 110. The feed directions 104, 106, 108, 110 are parallel to each other. The feed directions 100, 102 are oriented parallel to each other and, for example, approximately perpendicular to the other feed directions 104, 106, 108, 110. In the event that several frontal mold parts are used, further (lateral) feed directions may be provided, which do not necessarily have to be parallel to any other (lateral) feed directions.

A frontal shaping portion 116 is formed on the first frontal mold part 54. A frontal shaping portion 118 is formed on the second frontal mold part 56. A lateral shaping portion 120 is formed on the first transversal mold part 64. A lateral shaping portion 122 is formed on the second transverse mold part 66. A frontal shaping portion 124 is formed on the first punch 74. A frontal shaping portion 126 is formed on the second punch 76.

In the context of the present disclosure, a frontal shaping portion is to be understood as a portion of the respective mold part which defines the cavity 48 and/or the shape of the article 10 to be produced, and which extends substantially transversely or perpendicularly to the feed direction of the used mold part. On the other hand, a lateral shaping portion is a section of the mold part which defines the cavity 48 or the shape of the article 10 to be produced, and which extends approximately parallel or slightly inclined to the respective feed direction of the mold part.

Together, the shaping portions 116, 118, 120, 122, 124, 126 define the shape of the pressed article 10 to be produced, which results from the design of the cavity 48. For an illustration of the cavity 48, reference is also made to the detailed views of FIGS. 11 and 13.

The frontal mold parts 54, 56 can be fed laterally, refer to the feed directions 100, 102. The shaping portions 116, 118 of the frontal mold parts 54, 56 form lateral sections of the cavity 48 and the pressed article 10 to be formed. In certain embodiments, the lateral surface 30 of the pressed article 10 can be produced with the shaping portions 116, 118, cf. also FIGS. 1 to 4.

The punches 74, 76 are also provided with "frontal" shaping portions 122, 124, by means of which the respective surface 34 (cf. FIGS. 1 to 4) of the pressed article 10 is formed, which is exemplarily formed on the upper and lower side of the pressed article 10 to be produced. Thus, the surfaces 30, 34 to be formed by the "frontal" shaping portions 116, 118 and 122, 124 are basically perpendicular and/or, if at all, only slightly inclined with respect to the feed directions 100, 102 and 108, 110.

It can be clearly different for the transverse mold parts 64, 66, which can be fed along the feed directions 104, 106. The "lateral" shaping portions 120, 122 define portions and/or surfaces 32 of the pressed article 10 to be formed. The surfaces 32 may also be referred to as lateral surfaces, since they extend substantially perpendicular and/or only slightly inclined with respect to a horizontal plane that is formed by the axes X, Y. However, the feed directions 106, 108 of the punches 74, 76 are parallel to the Z axis. In other words, the transverse mold parts 64, 66 are fed vertically, for example from above or from below, although they form "lateral" sections or surfaces 32 of the pressed article 10. Thus, the feed direction and operating direction of the shaping portion are oriented approximately transversely to each other.

This enables a vertical, opposite demolding of the surfaces 32, which define the relief faces 22 of the cutting edges 16. Lateral demolding (along the X-direction) is not possible, since in this case the constriction 14 of the main body 12 would form an undercut area. Lateral demolding in the Y-direction would be disadvantageous, as then a mold partition transverse or perpendicular to the course of the cutting edge 18 would be necessary.

Figure 11:
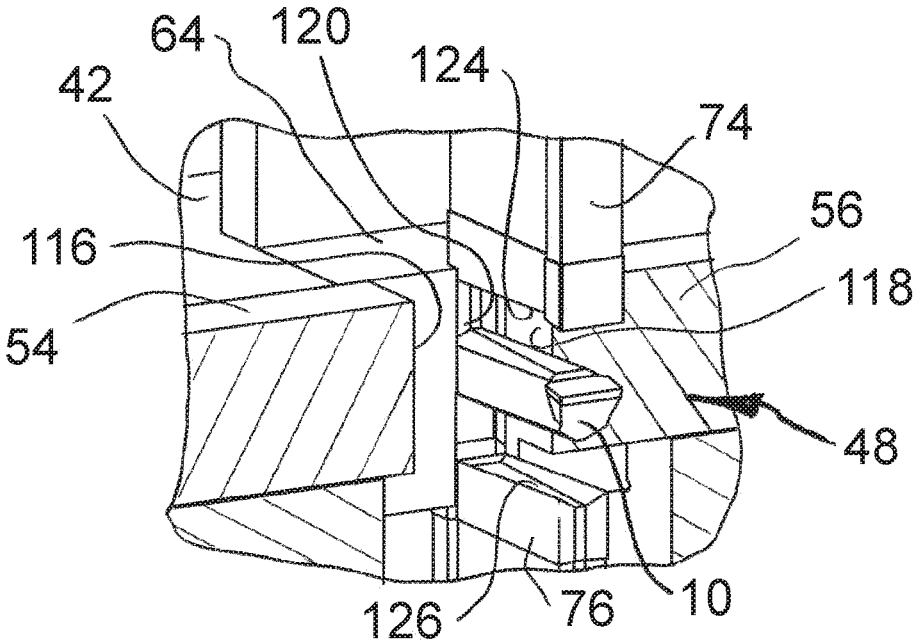
FIG. 11 is a detailed view of the illustration according to FIG. 10 to elucidate the cavity.

The interaction of the shaping portions 116, 118, 120, 122, 124 can be seen for instance in the enlarged illustration in FIG. 11, wherein the cavity 48 is not shown there in a completely closed state, and wherein the shaping portion 122 of the transverse mold part 66 is not shown there due to the cut-out representation.

With reference to FIGS. 5 to 11, an exemplary manufacturing sequence for the production of the pressed article 10 is illustrated. Starting from an open position, in which the frontal mold parts 54, 56, the transverse mold parts 64, 66 and the punches 74, 76 are extended at least to some extent compared to a closed position, the cavity is then closed at least partially, cf. for instance FIG. 6.

FIG. 6 illustrates a filling configuration in which at least the frontal mold parts 54, 56 and the transverse mold parts 64, 66 are in the closed position. In other words, a cavity 48 is already defined which can be filled with a hard-metal powder. For this purpose, the device 40 comprises a filling unit 132, which comprises a filling shoe 134. In certain embodiments, the filling shoe 134 can be fed to an upper side of the die 46 to fill the cavity 48, cf. also FIG. 6 and FIG. 7. A feed direction of the filling shoe 134 is indicated by 136 in FIG. 7. The filling shoe 134 can be fed along a horizontal plane that is defined by the X axis and the Y axis.

By way of example, the filling shoe 134 is placed above the opening 50, through which the (upper) punch 74 can retract. Accordingly, at least the punch 74 of the punch unit 82 is in the filling configuration spaced away from the die 46. This is elucidated in the views of FIGS. 6 and 7.

The (upper) transverse mold part 64 is also provided with a corresponding recess so that the filling shoe 134 can be fed to the cavity 48. Generally, the filling of cavity 48 with the hard-metal powder is supported by gravity.

In certain embodiments, the punch 74 is guided on a guide arm 138, especially on a guide profile 92 thereof (see FIG. 5), in order to provide enough space for the filling shoe 134. The coupling of the guides of the punch 74 and the transverse mold part 64 provides the required accessibility for the filling shoe 134.

Similarly, a guide arm 140 may also be designed for the (lower) transverse mold part 66, on which the (lower) punch 76 is guided via a corresponding guide profile 92.

The federal guide profiles 94 of the transverse mold parts 64, 66 (see again FIG. 5) are arranged adjacent to the lateral shaping portions 120, 122.

Figure 8:
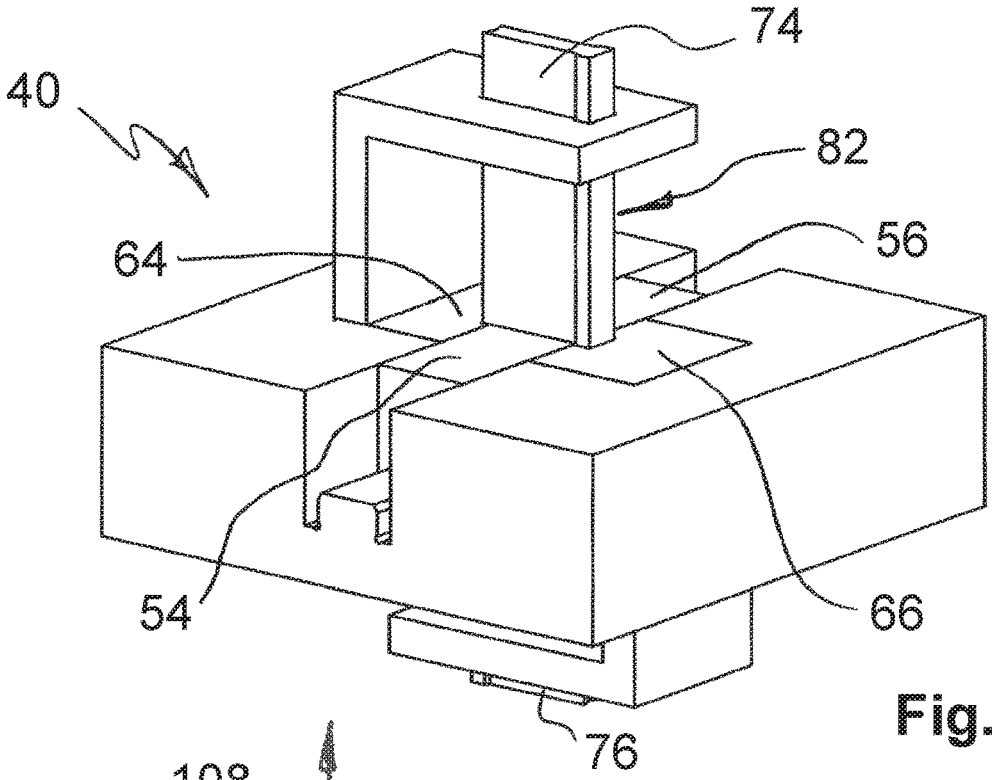
FIG. 8 is a further view of the design according to FIGS. 5 to 7, where a die is closed, and wherein punches are retracted for pressing.

FIG. 8 shows a closed pressing state in which the punches 74, 76 are also retracted into the die 46 in order to pressurize the hard-metal powder located therein. Now the punches 74, 76 are coupled to both the guide profile 92 on the guide arm 138, 140 and the guide profile 94, which is adjacent to shaping portion 120, 122. This allows precise guidance and force application, especially during the pressurizing process.

Figure 9:
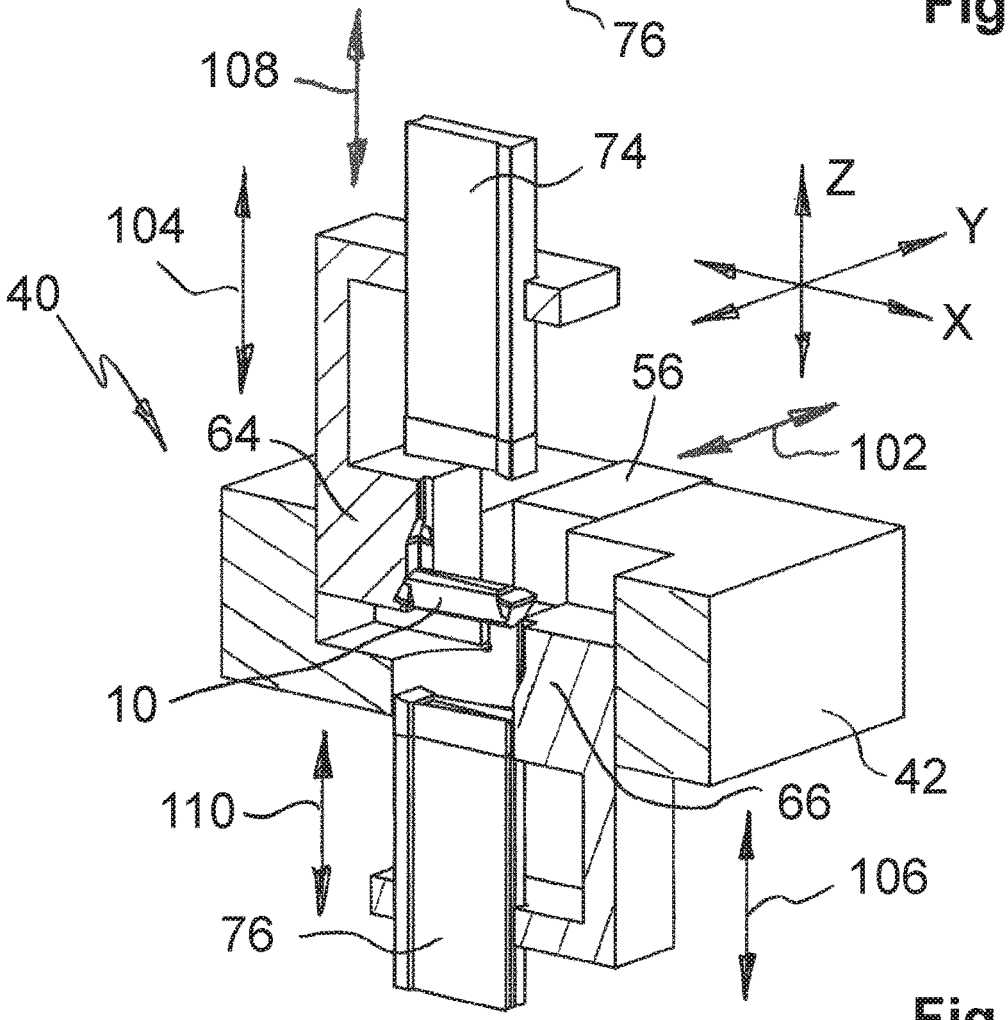
FIG. 9 is a perspective sectional view of the arrangement according to FIG. 8, wherein the punches of the device and the formed pressed article are not cut for illustrative reasons, and wherein the punches and mold parts of the device are slightly extended for better representability.

FIG. 9 shows in a partially cross-sectional representation a state after the actual pressing process in which the pressed article 10 is formed. For illustrative reasons, FIG. 9 does not show the pressed article 10 and the punches 74, 76 in a cross-sectional state. The cutting plane shown in FIG. 9 is located centrally in the die 46 and parallel to the X axis and the Z axis. Furthermore, in FIG. 9 the mold parts 56, 64, 66 as well as the punches 74, 76 are shown in a partially disengaged state. The pressed article 10, which has a shape basically similar to that shown in FIGS. 1 to 4, can be demolded and/or removed.

For illustrative reasons, FIG. 9 does not show the pressed article 10 and the punches 74, 76 in a cut state. The cutting plane shown in FIG. 9 runs centrally through the die and parallel to the X axis and the Z axis.

Figure 10:
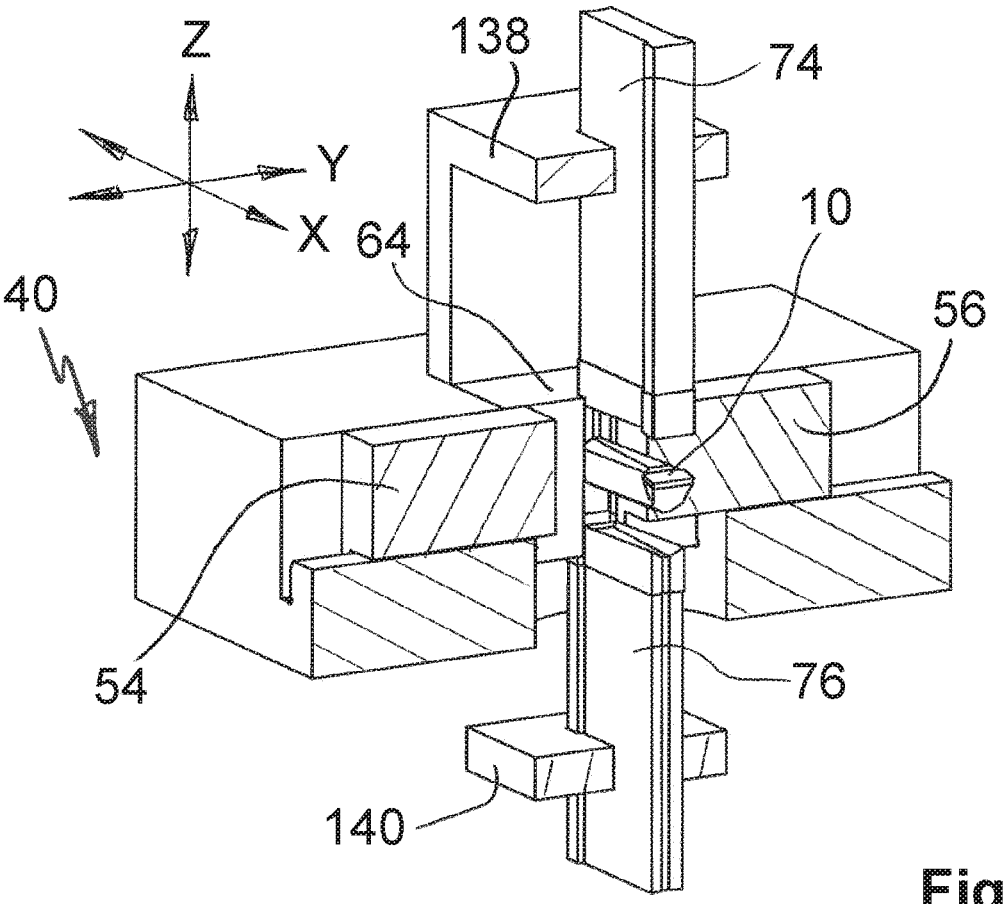
FIG. 10 is an additional sectional view of the design according to FIGS. 8 and 9 in an orientation deviating from that shown in FIG. 9.

FIG. 10 shows a corresponding perspective partial cut representation of the device 40 after the pressing process, wherein the cutting plane in FIG. 10 is oriented parallel to the Y axis and parallel to the Z axis. Again, the mold parts 54, 56, 64 as well as the punches 74, 76 are shown in a partially disengaged state. FIG. 11 illustrates a detailed representation of the arrangement according to FIG. 10. The interaction of the shaping portions 116, 118, 120, 122, 124, 126 can be derived in synopsis of FIGS. 9 to 11. In addition, reference is made to the further cross-sectional view of FIG. 12 and the corresponding detailed view of FIG. 13.

Figure 12:
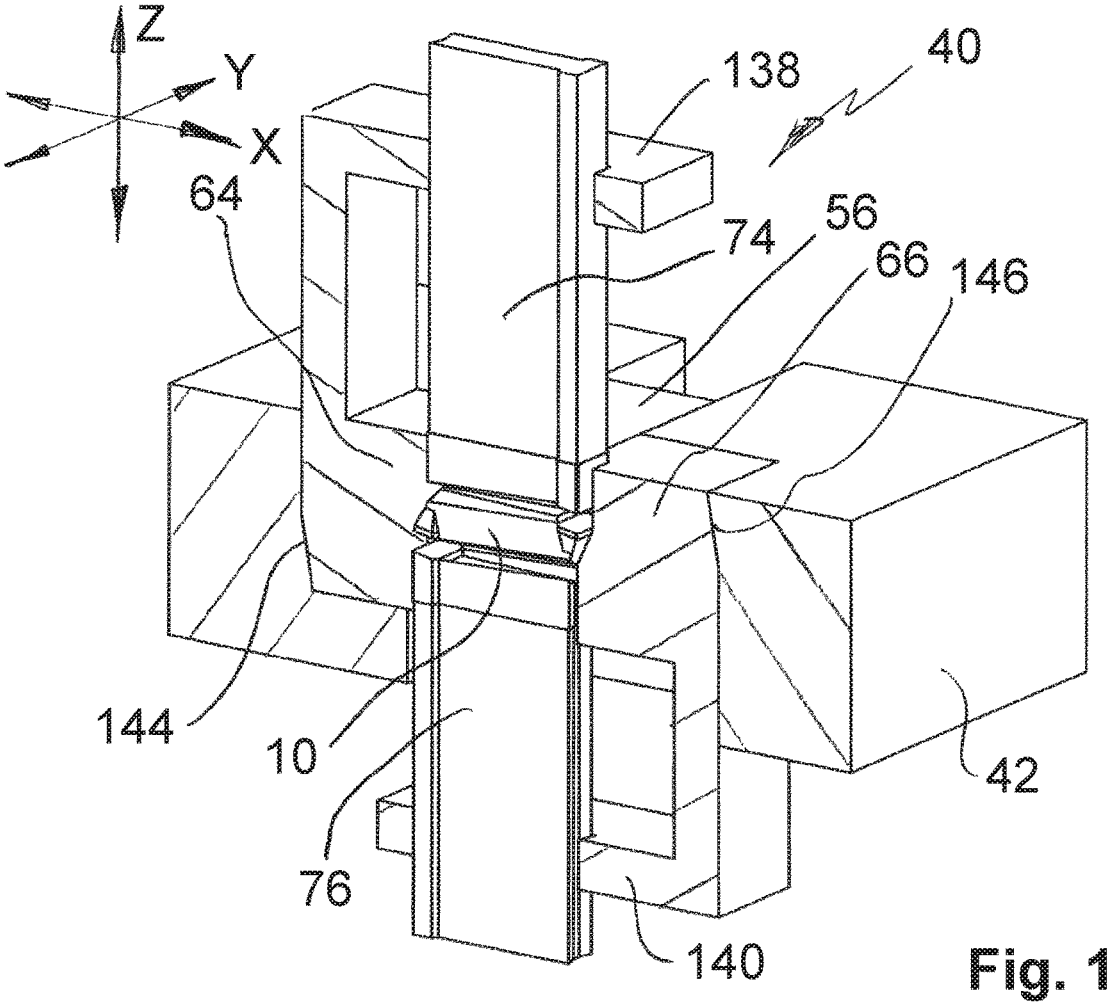
FIG. 12 is a sectional view of a further embodiment of a device for the manufacture of a pressed article, which is based on the view according to FIG. 9.

FIG. 12 shows another perspective, partially cut representation of a device designated by 40, the design of which is basically similar to the design of the device 40 shown in FIG. 9.

A further refinement may involve forming at the bed 42 abutment surfaces 144, 146, which may also be referred to as chamfers. From the sectional view in FIG. 12 it can be seen that corresponding mating surfaces are formed on the transverse mold parts 64, 66. In this way, a high-precision positioning and alignment of the transverse mold parts 64, 66 with respect to the bed 42 can be achieved. This results in a highly precisely defined cavity.

Figure 13:
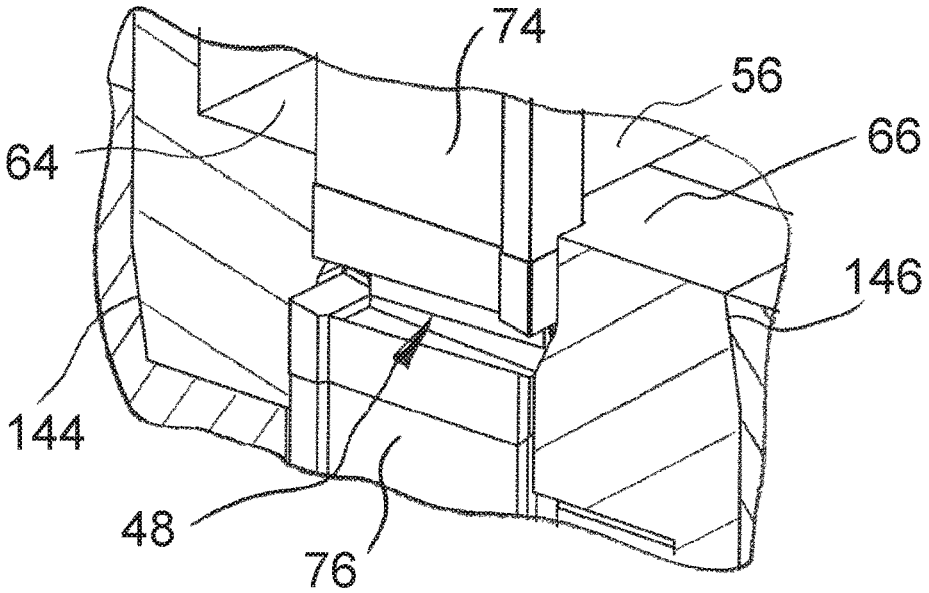
FIG. 13 is a detailed view of the arrangement according to FIG. 12 to elucidate a cavity, wherein the pressed article is not shown in FIG. 13 for illustrative reasons.

For illustrative purposes, the pressed article 10 is not shown in the supplementary detailed illustration according to FIG. 13. FIG. 13 also shows the mold parts 64, 66 and 56 in the closed position. The punches 74, 76 are also shown in the retracted, closed position. In this way, the cavity 48 is illustrated, which is a negative of pressed article 10.

Figure 14:
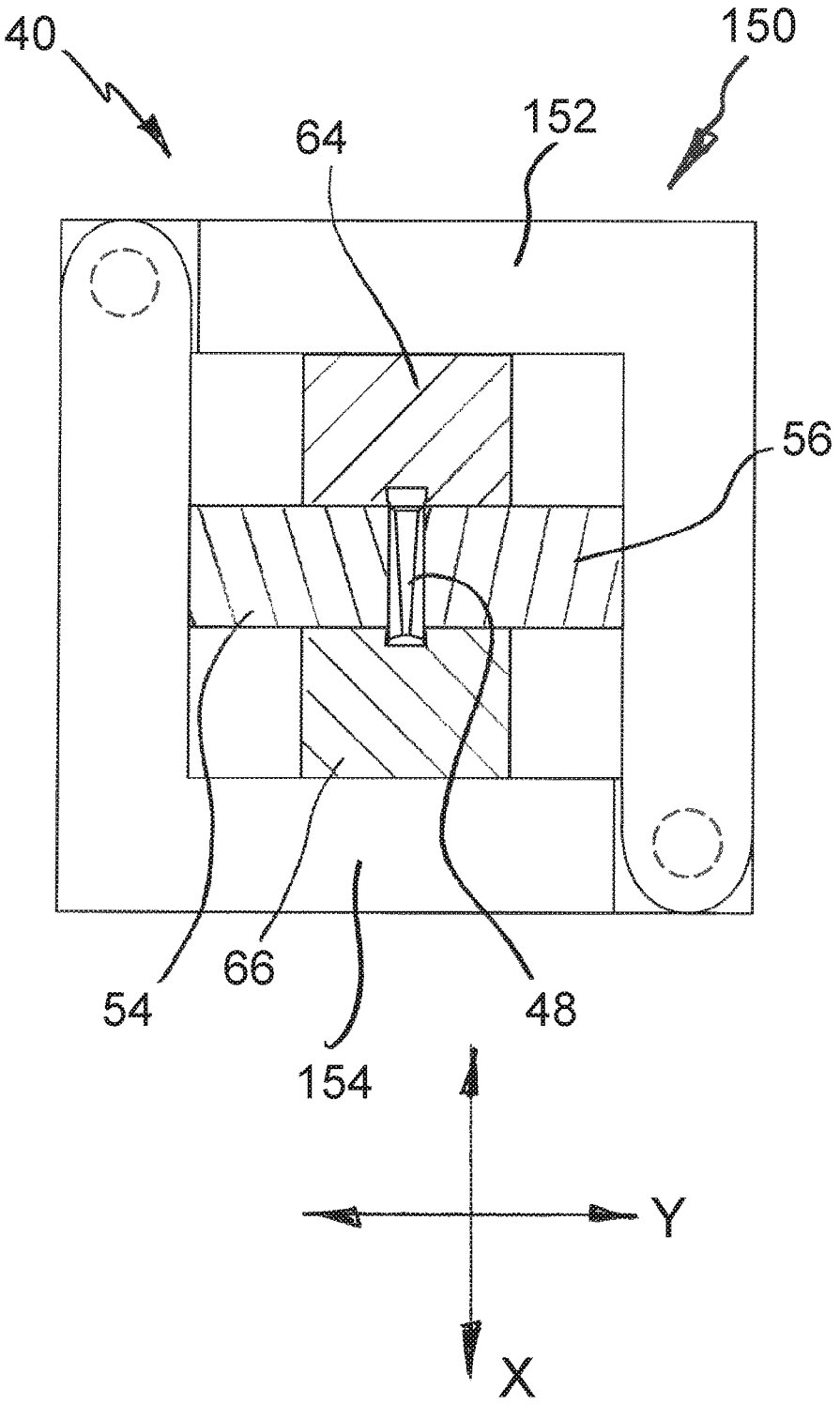
FIG. 14 is a schematic, greatly simplified, partial cross-sectional top view of an embodiment of a device for the manufacture of pressed articles, for elucidating a locking device.

FIG. 14 shows a schematic, greatly simplified, partially cut top view of another embodiment of the device 40. In FIG. 14, the cutting plane is oriented approximately parallel to the X axis and the Y axis, and central in the cavity 48. The frontal mold parts 54, 56 and the transverse mold parts 64, 66 are therefore shown in a cut representation.

FIG. 14 also illustrates a locking device designated by 150, which is designed to accommodate lateral forces or pressures during the pressing process. In other words, the locking device 150 is used to fix or lock the frontal mold parts 54, 56 and the transverse mold parts 64, 66 in the closed position in order to form the cavity 48 with high precision.

By way of example, the locking device 150 can comprise at least one holder 152, 154. The locking device 150 can support and fix the mold parts 54, 56, 64, 66 positively, non-positively or in any other suitable way, at least during the pressing process.

What is claimed is:

1. A method for near-net-shape manufacture of a hard-metal pressed article, the method comprising:

feeding at least one frontal mold part that is movable in a first plane, comprising feeding a first frontal mold part and a second frontal mold part of a multi-part die, feeding at least one transverse mold part that is movable in a second plane, comprising feeding an upper transverse mold part and a lower transverse mold part, providing a locking device for securing the transverse mold parts and frontal mold parts in a closed position to form a peripheral contour of a hard-metal pressed article, the locking device laterally securing the upper transverse mold part and the lower transverse mold part, and the first frontal mold part and the second frontal mold part, and locking the at least one frontal mold part and the at least one transverse mold part with the locking device to define a cavity which defines the shape of the hard-metal pressed article, wherein feed directions of the at least one frontal mold part and the at least one transverse mold part are inclined to one another, wherein the at least one frontal mold part and the at least one transverse mold part define surfaces of the hard-metal pressed article, and wherein the cavity comprises at least one opening through which a punch is insertable, and wherein the at least one opening is defined by the at least one frontal mold part and the at least one transverse mold part, feeding a filling shoe above the at least one opening in the cavity and filling the cavity with a hard-metal powder, and compressing the hard-metal powder with at least one punch that is movable parallel to a main pressing direction, the step of compressing the hard metal powder comprising feeding an upper punch and a lower punch to form the hard-metal pressed article, wherein the at least one transverse mold part is fed along a feed direction that is parallel to the main pressing direction.

2. The method as claimed in claim 1, wherein the at least one frontal mold part is fed in a horizontal plane, wherein the at least one transverse mold part is fed in a vertical plane, and wherein the feed directions of the at least one frontal mold part and the at least one transverse mold part are oriented perpendicular to each other.

3. The method as claimed in claim 1, wherein the at least one frontal mold part is fed laterally and provided with a frontal shaping portion defining a first portion of the shape of the hard-metal pressed article, and wherein the at least one transverse mold part is fed vertically and provided with a lateral shaping portion defining a second portion of the shape of the hard-metal pressed article.

4. The method as claimed in claim 1, wherein the at least one punch is fed vertically and provided with a frontal shaping portion that defines a portion of the shape of the hard-metal pressed article.

5. The method as claimed in claim 1, wherein the upper punch and the upper transverse mold part are associated with a first side, wherein the lower punch and the lower transverse mold part are associated with a second side, wherein the upper punch and the upper transverse mold part are fed at least partially via common guide elements, and wherein the lower punch and the lower transverse mold part are fed at least partially via common guide elements.

6. The method as claimed in claim 1, further comprising a demolding step after the step of compressing the hard-metal powder, including opening the multi-part die, comprising extending the at least one frontal mold part, extending the at least one transverse mold part, and extending the at least one punch, wherein the at least one transverse mold part is moved parallel to the main pressing direction to release at least a portion of the hard-metal pressed article.

7. The method as claimed in claim 1, wherein the step of feeding a filling shoe comprises laterally feeding the filling shoe to an upper opening of the cavity, wherein the filling shoe is guided into a clearance space provided by the upper punch that is spaced from the cavity.

8. The method as claimed in claim 1, wherein the locking device secures the transverse mold parts and frontal mold parts by encircling the transverse mold parts and frontal mold parts.

9. The method as claimed in claim 5, wherein the upper punch and the lower transverse mold part together define a first cutting edge, and wherein the lower punch and the upper transverse mold part together define a second cutting edge.

10. The method as claimed in claim 9, wherein the first cutting edge is associated with a first rake face and a first relief face, wherein the second cutting edge is associated with a second rake face and a second relief face, and wherein the first rake face is formed by the upper punch, the second rake face by the lower punch, the first relief face by the lower transverse mold part, and the second relief face by the upper transverse mold part.

11. A method for the manufacture of a hard-metal cutting tool, comprising:

manufacturing a hard-metal pressed article in accordance with the method as claimed in claim 1, transferring the article from a pressing plant to a sintering plant, and sintering the hard metal pressed article to produce the hard-metal cutting tool.

12. A method for near-net-shape manufacture of a hard-metal pressed article comprising:

feeding at least one frontal mold part that is movable in a horizontal plane, comprising feeding a first frontal mold part and a second frontal mold part of a multi-part die, feeding at least one transverse mold part that is movable in a vertical plane, comprising feeding an upper transverse mold part and a lower transverse mold part, providing a locking device for securing the transverse mold parts and frontal mold parts in a closed position to form a peripheral contour of a hard-metal pressed article, the locking device laterally securing the upper transverse mold part and the lower transverse mold part, and the first frontal mold part and the second frontal mold part, and locking the at least one frontal mold part and the at least one transverse mold part with the locking device to define a cavity which defines the shape of the hard-metal pressed article, wherein feed directions of the at least one frontal mold part and the at least one transverse mold part are perpendicular to one another, wherein the at least one frontal mold part and the at least one transverse mold part define surfaces of the hard-metal pressed article, and wherein the cavity comprises at least one opening through which a punch is insertable; and wherein the at least one opening is defined by the at least one frontal mold part and the at least one transverse mold part feeding a filling shoe above the at least one opening in the cavity and filling the cavity with a hard-metal powder, and compressing the hard-metal powder with at least one punch that is movable parallel to a main pressing direction, the step of compressing the hard-metal powder comprising feeding an upper punch and a lower punch to form the hard-metal pressed article, each having a vertical reed direction, wherein the at least one transverse mold part is fed along a feed direction that is parallel to the main pressing direction.

13. A method for the manufacture of a hard-metal pressed blank for indexable, cutters that are arranged as two-edge cutters comprising two opposite edges, the method comprising:

feeding at least one frontal mold part that is movable in a horizontal plane, comprising feeding a first frontal mold part and a second frontal mold part of a multi-part die, feeding at least one transverse mold part that is movable in a vertical plane, comprising feeding an upper transverse mold part and a lower transverse mold part, providing a locking device for securing the transverse mold parts and frontal mold parts in a closed position to form a peripheral contour of a hard-metal pressed blank, wherein the locking device laterally encloses the upper transverse mold part, the lower transverse mold part, the first frontal mold part, and the second frontal mold part, and locking the at least one frontal mold part and the at least one transverse mold part with the locking device to define a cavity which defines the shape of the hard-metal pressed blank, wherein feed directions of the at least one frontal mold part and the at least one transverse mold part are perpendicular to one another, wherein the at least one frontal mold part and the at least one transverse mold part define surfaces of the hard-metal pressed blank, and wherein the cavity comprises at least one opening through which a punch is insertable, feeding a filling shoe above the at least one opening in the cavity and filling the cavity with a hard-metal powder, and compressing the hard-metal powder with at least one punch that is movable parallel to a main pressing direction, the step of compressing the hard-metal powder comprising feeding an upper punch and a lower punch, each having a vertical feed direction to form the hard-metal pressed blank, wherein the at least one transverse mold part is fed along a feed direction that is parallel to the main pressing direction, and wherein the upper punch and the lower transverse mold part together define a first cutting edge, and wherein the lower punch and the upper transverse mold part together define a second cutting edge of the hard-metal pressed blank.

* * * * *